US010801303B2

(12) United States Patent
Gray et al.

(10) Patent No.: US 10,801,303 B2
(45) Date of Patent: Oct. 13, 2020

(54) WELL FLUID FLOW CONTROL CHOKE

(71) Applicant: WEATHERFORD TECHNOLOGY HOLDINGS, LLC, Houston, TX (US)

(72) Inventors: Kevin L. Gray, Friendswood, TX (US); Gerald George, Magnolia, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 69 days.

(21) Appl. No.: 15/727,293

(22) Filed: Oct. 6, 2017

(65) Prior Publication Data

US 2019/0106963 A1 Apr. 11, 2019

(51) Int. Cl.

| | |
|---|---|
| ***E21B 34/02*** | (2006.01) |
| ***E21B 34/08*** | (2006.01) |
| ***E21B 21/08*** | (2006.01) |
| ***E21B 21/10*** | (2006.01) |
| ***E21B 47/117*** | (2012.01) |
| ***E21B 44/00*** | (2006.01) |
| ***E21B 47/06*** | (2012.01) |
| ***E21B 47/10*** | (2012.01) |

(52) U.S. Cl.

CPC ..... *E21B 34/08* (2013.01); *E21B 21/08* (2013.01); *E21B 21/106* (2013.01); *E21B 44/005* (2013.01); *E21B 47/06* (2013.01); *E21B 47/10* (2013.01); *E21B 47/117* (2020.05)

(58) Field of Classification Search

CPC ..... E21B 34/02; E21B 34/08; E21B 21/08; E21B 21/106

See application file for complete search history.

(56) References Cited

U.S. PATENT DOCUMENTS 4,971,099 A * 11/1990 Cyvas ..... E21B 34/02 137/270
6,283,152 B1 * 9/2001 Corte, Jr. ..... F16K 1/443 137/614.11

(Continued)

FOREIGN PATENT DOCUMENTS

CA 2369574 A1 7/2003
WO 2017039458 A1 3/2017

OTHER PUBLICATIONS

International Search Report with Written Opinion dated Mar. 18, 2019 for PCT Patent Application No. PCT/US2018/053158, 20 pages.

*Primary Examiner* — Cathleen R Hutchins
(74) *Attorney, Agent, or Firm* — Smith IP Services, P.C.

(57) ABSTRACT

A choke can include a variable flow restrictor, external ports in communication with a flow passage respectively upstream and downstream of the flow restrictor, and sensor(s) in communication with the external ports. A method can include flowing a well fluid through a flow passage in a body of a choke including a variable flow restrictor, measuring a pressure differential between external ports in communication with respective upstream and downstream sides of the flow restrictor, and operating the flow restrictor, thereby varying a restriction to the flow through the flow passage, in response to the measured pressure differential. A well system can include a well fluid pump, a flow choke including a variable flow restrictor operable by an actuator that includes a displaceable stem and a stem seal that isolates the actuator from the well fluid in the flow choke, and a control system that operates the actuator.

27 Claims, 7 Drawing Sheets

(56) References Cited

U.S. PATENT DOCUMENTS

| | | | | |
|---|---|---|---|---|
| 6,446,664 | B1 | 9/2002 | Parsons | |
| 6,684,897 | B2 * | 2/2004 | Sundararajan | F16K 31/122 137/15.19 |
| 6,883,614 | B2 | 4/2005 | Schmidt et al. | |
| 6,920,942 | B2 | 7/2005 | Koederitz | |
| 8,286,935 | B2 | 10/2012 | White | |
| 8,819,940 | B2 | 9/2014 | Rosengren et al. | |
| 8,978,497 | B2 | 3/2015 | Bourgoine et al. | |
| 2005/0092523 | A1 * | 5/2005 | McCaskill | E21B 21/08 175/38 |
| 2008/0149182 | A1 | 6/2008 | Burkhard et al. | |
| 2011/0240298 | A1 | 10/2011 | Rota et al. | |
| 2012/0024531 | A1 * | 2/2012 | Suter | E21B 21/106 166/321 |
| 2014/0033842 | A1 | 2/2014 | Morin et al. | |
| 2014/0262333 | A1 | 9/2014 | Frenzel et al. | |
| 2014/0311261 | A1 | 10/2014 | Rosengren et al. | |
| 2016/0108699 | A1 * | 4/2016 | Martino | E21B 34/02 166/91.1 |
| 2016/0372989 | A1 | 12/2016 | Bourgoine et al. | |
| 2017/0328151 | A1 | 11/2017 | Dillard et al. | |

* cited by examiner

WELL FLUID FLOW CONTROL CHOKE

BACKGROUND

This disclosure relates generally to equipment utilized and operations performed in conjunction with a subterranean well and, in an example described below, more particularly provides for well fluid flow control with a remotely controlled flow choke.

A flow choke can be used in well drilling operations to variably restrict flow of a well fluid. In managed pressure, underbalanced and other types of closed system drilling operations, the flow choke can be used to regulate pressure in a wellbore by variably restricting flow of well fluid from an annulus formed between a drill string and the wellbore.

Therefore, it will be readily appreciated that improvements are continually needed in the art of constructing and utilizing flow chokes and associated well systems. Such improvements may be useful in well operations other than closed system drilling operations (for example, a well control choke manifold could benefit from the improvements disclosed below and in the accompanying drawings).

DETAILED DESCRIPTION

Figure 1:
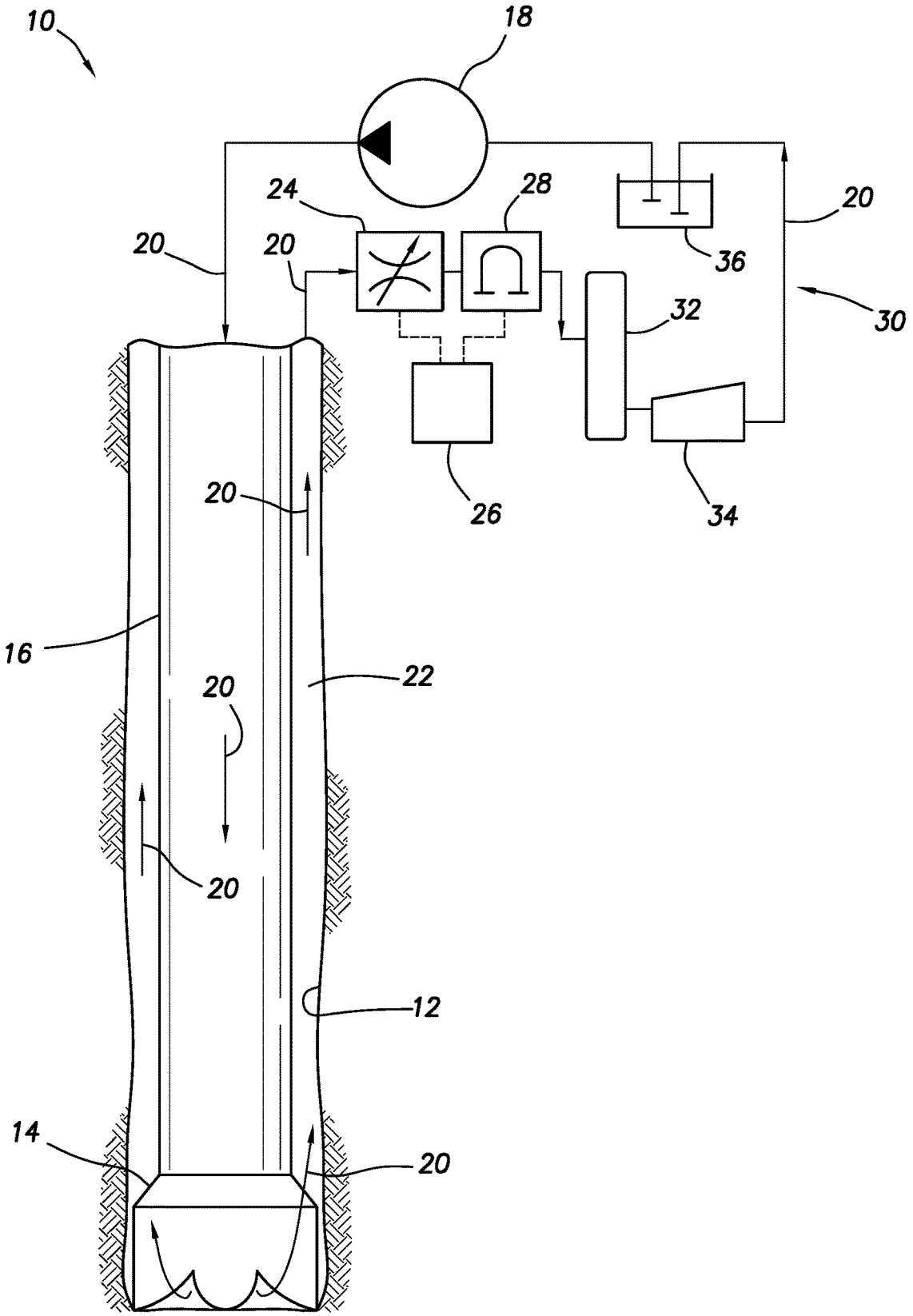
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is being drilled by rotating a drill bit 14 connected at a downhole end of a generally tubular drill string 16. A pump 18 (such as, a rig mud pump) pumps a well fluid 20 through the drill string 16, with the fluid returning to surface via an annulus 22 formed radially between the drill string and the wellbore 12.

Note that the term "well fluid" is used herein to indicate that the fluid 20 flows in the well. It is not necessary for the well fluid 20 to originate in the well, or for characteristics of the well fluid (composition, density, viscosity, etc.) to remain unchanged as it flows in the system 10. For example, the well fluid 20 flowed from the wellbore 12 in a drilling operation could include fines, cuttings, formation liquids or gas and/or other components, which components may be removed from the well fluid prior to it being re-introduced into the well.

Although not depicted in FIG. 1, various items of equipment may be provided in the system 10 to facilitate control of pressure in the wellbore 12 (for example, in order to prevent undesired fluid loss, fluid influxes, formation damage, or wellbore instability) during actual drilling, and while making connections in the drill string 16 or tripping the drill string into or out of the wellbore. The scope of this disclosure is not limited to only the combination of equipment, elements, components, etc., depicted in FIG. 1.

In some examples, a closed system may be provided by use of equipment variously known to those skilled in the art as a rotating control device (RCD), rotating control head, rotating drilling head, rotating diverter, pressure control device (PCD), rotating blowout preventer (RBOP), etc. Such equipment isolates the wellbore 12 from the atmosphere at surface by sealing off the annulus 22, thereby facilitating pressure control in the wellbore. In other examples, the wellbore 12 may be isolated from the atmosphere at surface during well control situations, and not necessarily during drilling operations.

In the FIG. 1 system 10, a variable flow choke 24 is used to restrict flow of the well fluid 20 from the annulus 22. In actual practice, the flow choke 24 may be part of an overall choke manifold (not shown) comprising multiple redundant chokes, shutoff valves, bypass lines, etc.

It will be appreciated by those skilled in the art that, with the well fluid 20 flowing from the annulus 22 and through the flow choke 24, restriction to flow of the well fluid through the flow choke can be decreased in order to decrease pressure in the annulus, and the restriction to flow through the flow choke can be increased in order to increase pressure in the annulus. A control system 26 can be used to operate the flow choke 24 in a manner that maintains a desired pressure in the wellbore 12.

The control system 26 can include, for example, a programmable logic controller (PLC) that operates the flow choke 24 so that a desired volumetric or mass flow rate of the well fluid 20 through the flow choke is maintained, so that a desired pressure is maintained in the annulus 22 at the surface, so that a desired pressure is maintained at one or more selected locations in the wellbore 12, or so that another desired objective or combination of objectives is obtained or maintained. In some examples, the PLC could control operation of the flow choke 24 using a proportional-integral-derivative (PID) algorithm.

The control system 26 may include various configurations of processors, static or volatile memory, input devices, output devices, remote communication devices, software, hardware, firmware, etc. The scope of this disclosure is not limited to any particular components or combination of components in the control system 26, or to use of a PLC controller or PID algorithm.

The control system 26 can receive input from a variety of different sources to enable the control system to effectively control operation of the flow choke 24. In the FIG. 1 example, the control system 26 receives an output of a flow meter 28 (depicted as a Coriolis-type flow meter) connected downstream of the flow choke 24. Thus, in this example, the control system 26 can operate the flow choke 24 so that a desired mass or volumetric flow rate of the fluid 20 through the flow choke is obtained and maintained. In some examples, other types of sensors (such as, temperature sensors, pressure sensors, pump stroke sensors, etc.) can provide their outputs to the control system 26.

As depicted in FIG. 1, fluid conditioning and storage equipment 30 used with the system 10 can include, for example, a gas separator 32, a solids shaker 34 and a mud tank 36 connected between the flow meter 28 and the pump 18. Of course, other or different fluid conditioning and storage equipment may be used in other examples incorporating the principles of this disclosure.

Figure 2:
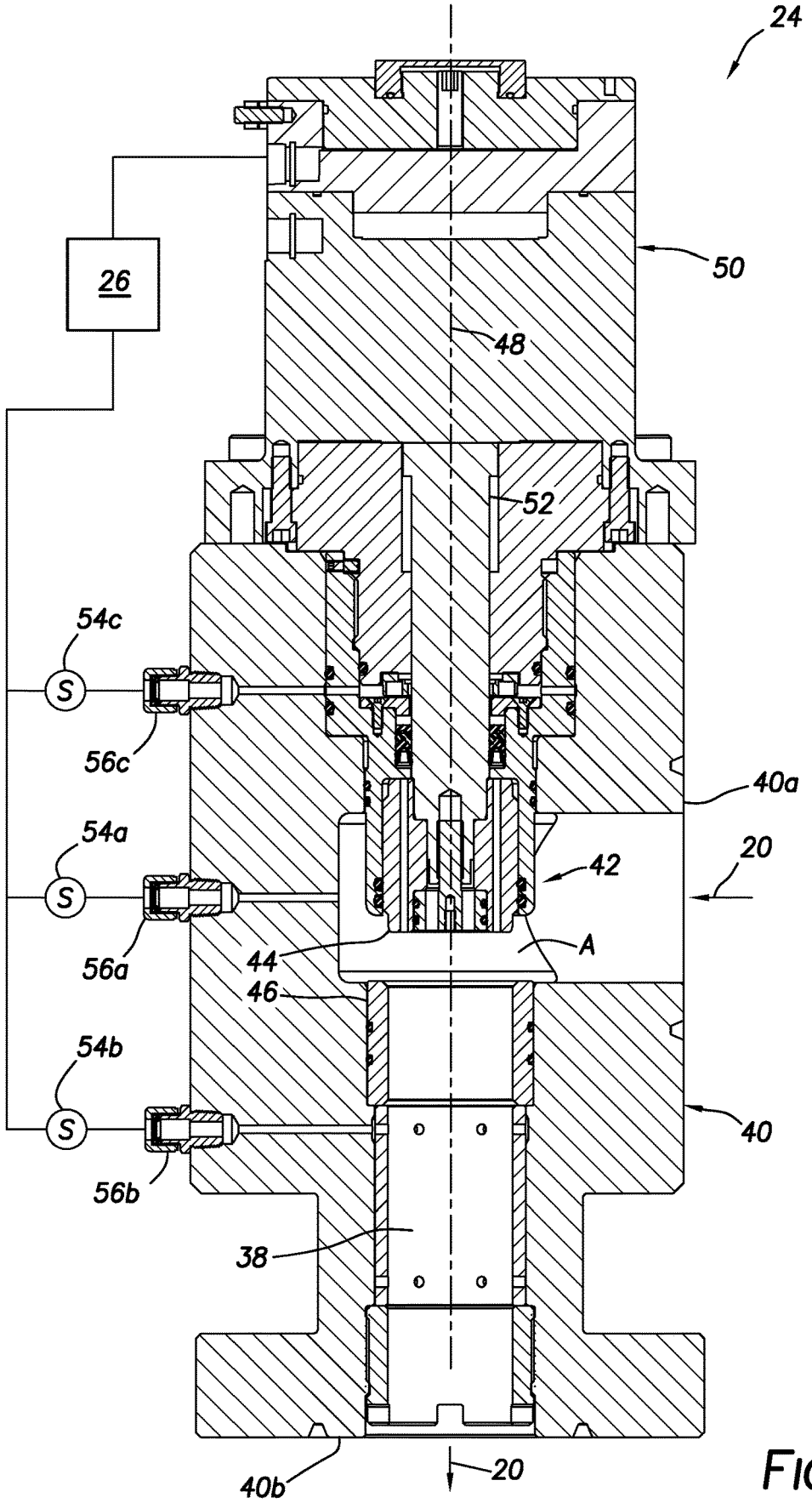
FIG. 2 is a representative cross-sectional view of an example of a flow choke that may be used with the system and method of FIG. 1, and which may embody the principles of this disclosure.

Referring additionally now to FIG. 2, a cross-sectional view of an example of the flow choke 24 as used in the system 10 and method of FIG. 1 is representatively illustrated. However, the FIG. 2 flow choke 24 may be used in other systems and methods, in keeping with the scope of this disclosure.

In the FIG. 2 example, the flow choke 24 includes a flow passage 38 formed through a body 40 of the flow choke. The body 40 includes inlet and outlet flanged connections 40*a,b* for connecting the flow choke 24 between the annulus 22 (e.g., at a wellhead or RCD, not shown in FIG. 1) and the flow meter 28 in the system 10. In other examples, the flow choke 24 could be connected between other components.

A flow restrictor 42 variably restricts flow of the fluid 20 through the flow passage 38. In this example, the flow restrictor 42 includes a gate or other closure member 44 that is displaceable relative to a flow orifice, bean or seat 46 that encircles the flow passage 38. Other types of variable flow restrictors may be used in other examples.

A flow area A between the closure member 44 and the seat 46 can be varied by displacing the closure member longitudinally relative to the seat. As depicted in FIG. 2, downward displacement of the closure member 44 relative to the seat 46 (along a longitudinal axis 48) will decrease the flow area A, and subsequent upward displacement of the closure member will increase the flow area.

The closure member 44 is displaceable by means of an actuator 50 connected to the body 40. The actuator 50 displaces a thrust rod or stem 52 connected to the closure member 44, to thereby vary the flow area A between the closure member and the seat 46.

The actuator 50 in this example comprises a linear actuator that displaces the stem 52 along the longitudinal axis 48. In some examples, the actuator 50 could comprise an axially aligned annular hydraulic motor with planetary gearing, and with a body of the actuator being directly connected to the flow choke body 40. However, the scope of this disclosure is not limited to any particular type of actuator used to operate the flow restrictor 42. In other examples, other types of electrical, hydraulic, pneumatic, etc., actuators or combinations thereof may be used.

The actuator 50 is connected to the control system 26, so that operation of the actuator 50 (and, thus, the flow restrictor 42 and flow choke 24) is controlled by the control system. The restriction to flow of the fluid 20 through the flow restrictor 42 can be varied by the control system 26 to obtain or maintain any of the desired objectives mentioned above. However, the scope of this disclosure is not limited to any particular objective accomplished by operation of the flow restrictor 42 by the control system 26.

The control system 26 receives outputs from sensors 54*a-c* connected to external ports 56*a-c* on the flow choke body 40. In this example, the sensors 54*a-c* comprise pressure transducers or sensors, but in some examples they may also comprise temperature sensors and/or other types of sensors. The scope of this disclosure is not limited to use of any particular type of sensor or combination of sensors with the flow choke 24.

The ports 56*a-c* are depicted in FIG. 2 as including conventional tubing connectors, but other types of connectors may be used in other examples. Alternatively, the sensors 54*a-c* may be connected directly to the body 40, without use of separate connectors (for example, by threading the sensors into the body at the ports 56*a-c*). Thus, the scope of this disclosure is not limited to use of any particular type of connector with the ports 56*a-c*, or to use of separate connectors at all.

As depicted in FIG. 2, the flow choke 24 is in a fully open configuration. The closure member 44 is displaced to its maximum upward stroke extent, so that a longitudinal distance between the closure member and the seat 46 is at a maximum, and the flow area A is at a maximum. Relatively unrestricted flow of the fluid 20 through the flow passage 38 is permitted in this fully open configuration.

Figure 3:
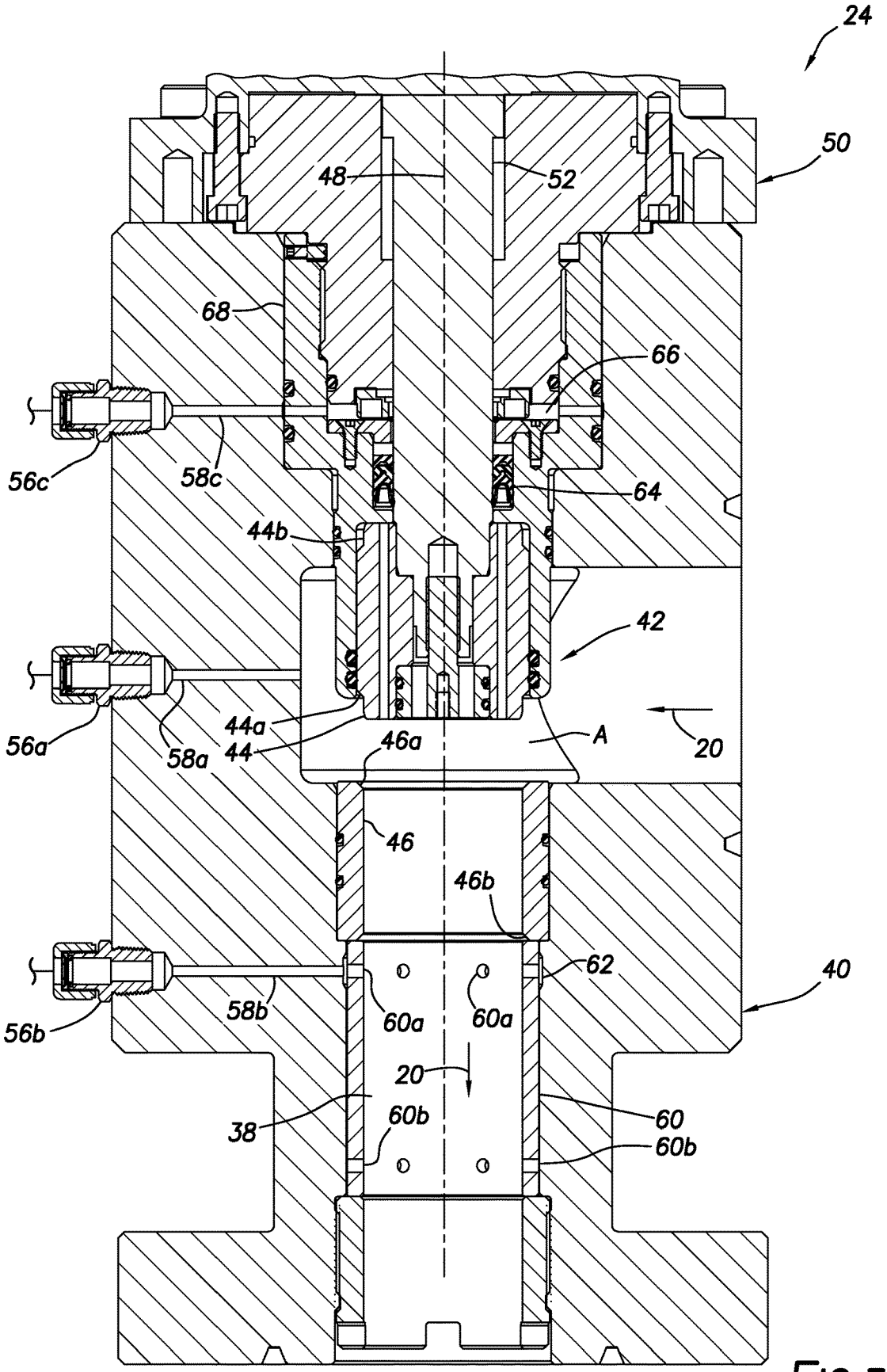
FIG. 3 is a representative cross-sectional view of the flow choke in a fully open configuration.

Referring additionally now to FIG. 3, a somewhat enlarged scale cross-sectional view of a portion of the flow choke 24 in the open configuration is representatively illustrated. In this view, components of the flow choke 24 may be more clearly seen.

Note that the external port 56*a* is in fluid communication with the flow passage 38 upstream of the flow restrictor 42 (relative to a direction of flow of the fluid 20) by means of a fluid line 58*a* extending through the body 40. Similarly, the external port 56*b* is in fluid communication with the flow passage 38 downstream of the flow restrictor 42 (relative to the direction of flow of the fluid 20) by means of a fluid line 58*b* extending through the body 40.

Thus, the sensors 54*a,b* (see FIG. 2) connected to the respective external ports 56*a,b* can be used to measure fluid pressure in the flow passage 38 respectively upstream and downstream of the flow restrictor 42. A difference between these measured fluid pressures is a pressure differential across the flow restrictor 42. Alternatively, a single pressure differential sensor (not shown) connected to both of the external ports 56*a,b* could be used to directly measure the pressure differential.

The measured pressure differential can be used to determine a flow rate of the fluid 20 through the flow choke 24, for example, as a "check" or verification of the flow rate measurements output by the flow meter 28 (see FIG. 1), or in the event of malfunction of the flow meter 28 or inaccuracies in its measurements (for example, due to excessive two-phase flow through the flow meter). A previously empirically determined flow coefficient or flow factor for the flow choke 24 may be used to calculate the flow rate of the fluid 20, based on the measured pressure differential.

In the case of an empirically determined flow coefficient (Cv), the following equation (1) may be used:

$$Cv=Q*(SG/\Delta P)^{1/2} \quad (1)$$

in which Q is the volumetric flow rate in US gallons per minute, SG is the specific gravity of the fluid 20, and ΔP is the differential pressure in pounds per square inch.

Solving for the flow rate Q results in the following equation (2):

$$Q=Cv*(\Delta P/SG)^{1/2} \quad (2)$$

Thus, with an empirically derived flow coefficient Cv, known specific gravity SG and measured differential pressure ΔP, the flow rate Q can be conveniently calculated. A similar calculation may be used in the case of an empirically determined flow factor (Kv) in SI metric units.

The flow rate calculation may be performed by the control system 26 in this example. The calculated flow rate may be used by the control system 26 to directly control operation of the flow choke 24 (such as, by varying the flow restriction to obtain and maintain a desired flow rate set point), or the calculated flow rate may be used in further calculations (for example, to obtain and maintain a desired pressure in the wellbore 12). The scope of this disclosure is not limited to any particular use for the calculated flow rate through the flow choke 24. Calculation of the flow rate may not be necessary or may not be performed in other examples.

In a closed configuration, the closure member 44 can be displaced by the actuator stem 52 into contact with a sealing surface 46*a* on the seat 46. Another sealing surface 46*b* is formed on an opposite end of the seat 46, so that the seat can be reversed in the flow choke 24, in the event that the sealing surface 46*a* becomes damaged, eroded or otherwise unable to function satisfactorily in sealingly engaging the closure member 44. When the seat 46 is reversed, the closure member 44 can be displaced by the actuator stem 52 into contact with the sealing surface 46*b*.

The closure member 44 is also reversible. Near one end, the closure member 44 has a sealing surface 44*a* for engagement with the sealing surface 46*a* or 46*b* of the seat 46. Another sealing surface 44*b* is formed near an opposite end of the closure member 44, so that the closure member can be reversed in the flow choke 24, in the event that the sealing surface 44*a* becomes damaged, eroded or otherwise unable to function satisfactorily in sealingly engaging the seat 46.

The fluid line 58*b* is in communication with the flow passage 38 via openings 60*a* formed through a sleeve 60 positioned in the body 40. The sleeve 60 provides erosion resistance about the flow passage 38 downstream of the seat 46.

An annular recess 62 in the body 40 enables the fluid line 58*b* to communicate with all of the openings 60*a* circumferentially about the sleeve 60. The sleeve 60 is reversible in the body 40, so that the fluid line 58*b* can communicate with the flow passage via openings 60*b* formed through the sleeve near an opposite end of the sleeve.

A seal 64 (depicted in FIG. 3 as a stack of V- or chevron-type packing) sealingly engages an exterior surface of the stem 52. The seal 64 is preferably suitable to isolate an interior of the actuator 50 from the fluid 20 in the flow passage 38 (e.g., with a pressure rating appropriate to resist the fluid pressure in the flow passage).

In the event of a leak past the seal 64, the fluid 20 will accumulate in an annular chamber 66 formed radially between the stem 52 and an adapter 68 used to interface the actuator 50 with the valve body 40. The fluid line 58*c* is in communication with the chamber 66, and so the sensor 54*c* (connected to the external port 56*c*, see FIG. 2) can detect if the fluid 20 has leaked past the seal 64.

In response to an indication from the sensor 54*c* that a leak has occurred, or that fluid has otherwise accumulated in the chamber 66, the control system 26 may record data corresponding to the leak event (e.g., time, level, pressure, etc.), provide an indication that the seal 64 requires service, and/or provide an alarm (such as, a visual, audible, textual and/or tactile alarm). An early indication of seal 64 leakage can help to ensure that the problem is mitigated at the earliest appropriate opportunity.

Figure 4:
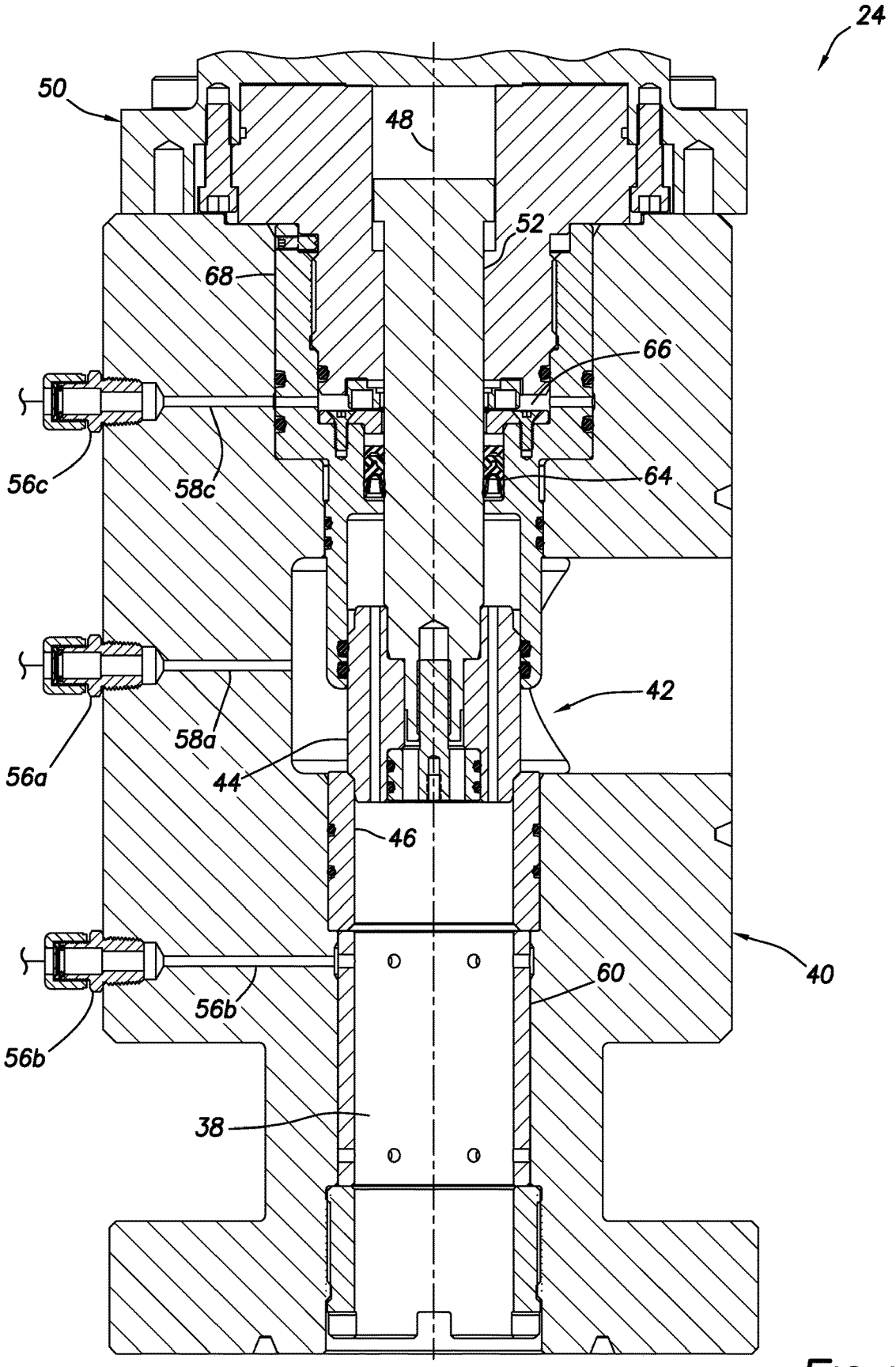
FIG. 4 is a representative cross-sectional view of the flow choke in a fully closed configuration.

Referring additionally now to FIG. 4, the flow choke 24 is representatively illustrated in the closed configuration. In this example, flow of the fluid 20 through the passage 38 is completely prevented, due to sealing engagement between the closure member 44 and the seat 46.

In other examples, engagement between the closure member 44 and the seat 46 may result in substantially complete (but not entirely complete) prevention of flow through the flow restrictor 42. In these examples, engagement between the closure member 44 and the seat 46 may result in maximum resistance to flow through the passage 38, and a separate shutoff valve may be used when complete prevention of flow is desired.

Note that engagement between the closure member 44 and the seat 46 is not required. In some examples, there may be no direct contact between the closure member 44 and the seat 46 when maximum resistance to flow through the flow choke 24 is achieved. In addition, if the flow restrictor 42 is of another type, the closure member 44 and seat 46 may not be used. Thus, the scope of this disclosure is not limited to any particular configuration, combination or manner of operation of components in the flow restrictor 42.

A more detailed view of the flow restrictor 42 in the closed configuration is representatively illustrated in FIG. 6, and is described more fully below.

Figure 5:
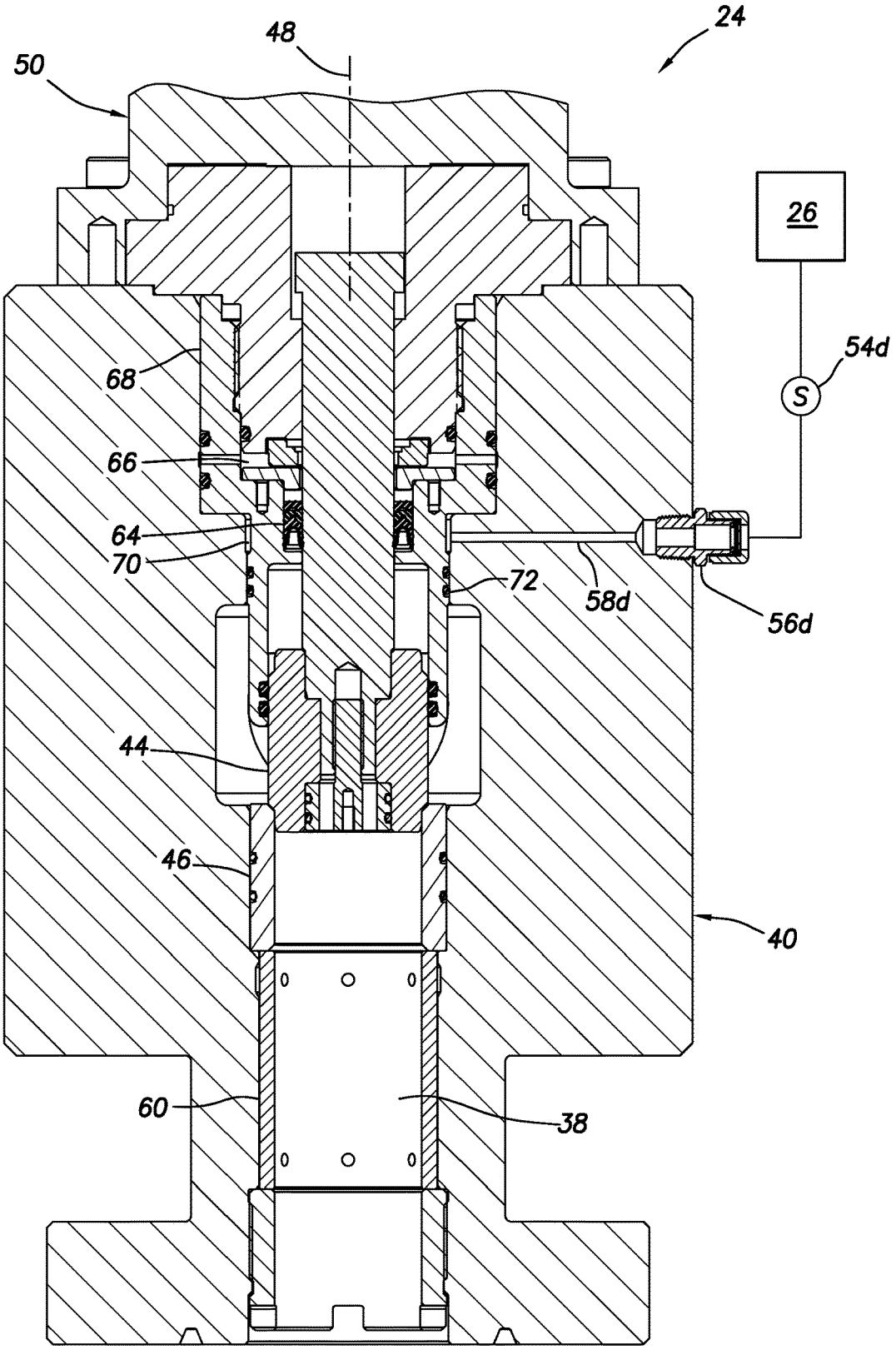
FIG. 5 is a representative cross-sectional view of the flow choke in the closed configuration, the FIG. 5 view being rotationally offset with respect to the FIG. 4 view.

Referring additionally now to FIG. 5, another cross-sectional view of the flow choke 24 is representatively illustrated. The view depicted in FIG. 5 is rotationally offset (rotated about the longitudinal axis 48) relative to the view depicted in FIG. 4, so that another external port 56*d* in the body 40 is visible.

The external port 56*d* is in fluid communication via a fluid line 58*d* with an annular chamber 70 formed radially between the body 40 and the adapter 68. The chamber 70 is isolated from the passage 38 by one or more seals 72.

In the event of a leak past the seals 72, the fluid 20 will accumulate in the annular chamber 70. The fluid line 58*d* is in communication with the chamber 70, and so a sensor 54*d* connected to the external port 56*d* can detect if the fluid 20 has leaked past the seals 72. The sensor 54*d* may be the same as, or similar to, the sensors 54*a-c*.

In response to an indication from the sensor 54*d* that a leak has occurred, or that fluid has otherwise accumulated in the chamber 70, the control system 26 may take any of the actions mentioned above (record data corresponding to the leak event, provide an indication that the seals 72 require service, or provide an alarm). However, the scope of this disclosure is not limited to any particular actions taken by the control system 26 in response to an indication of seal 64 or seals 72 leakage.

Figure 6:
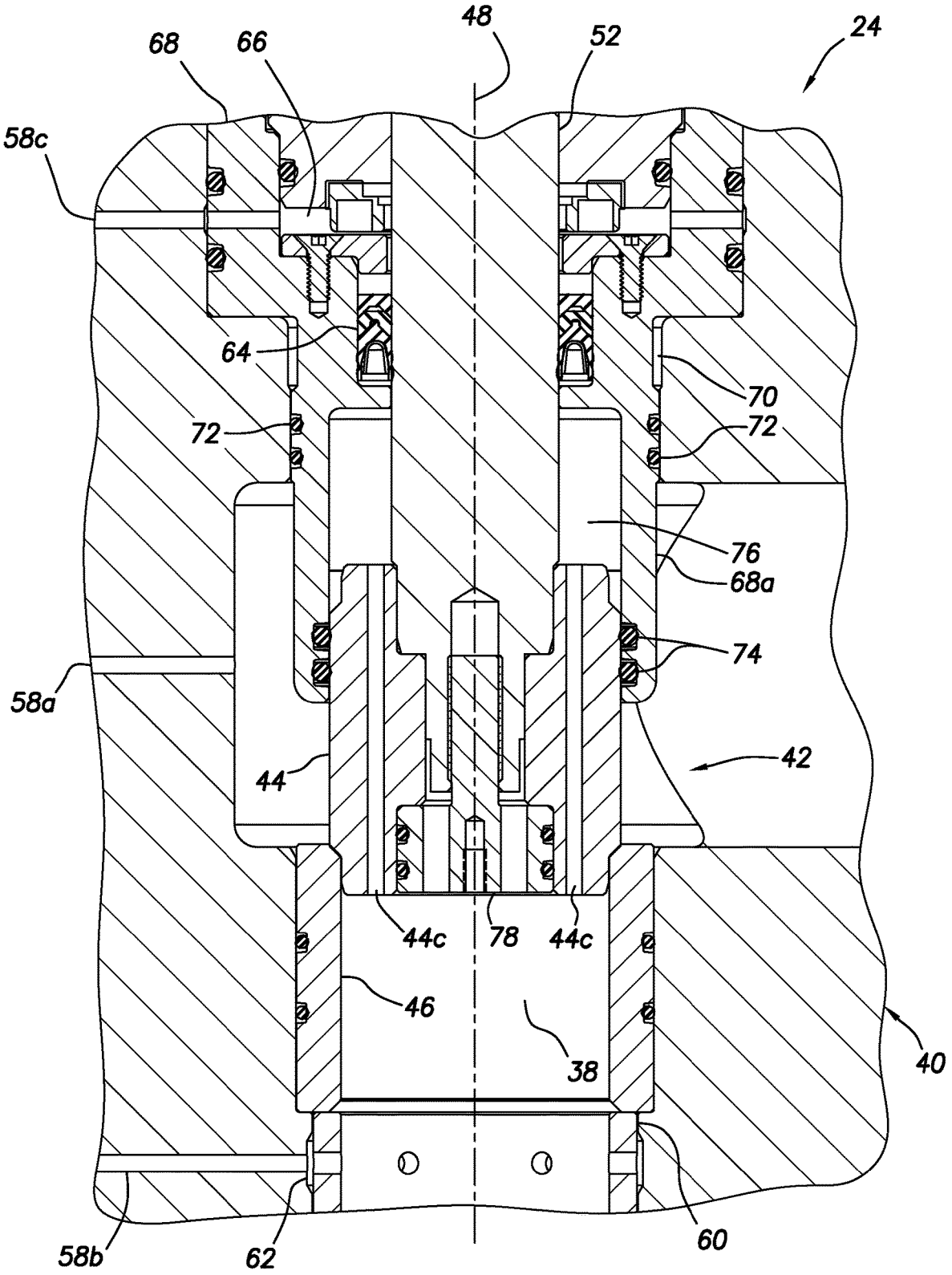
FIG. 6 is a representative cross-sectional view of an example of a flow restrictor of the flow choke in the closed configuration.

Referring additionally now to FIG. 6, a more detailed cross-sectional view of the flow restrictor 42 is representatively illustrated in the closed configuration. In this view, a pressure balancing feature of the flow restrictor 42 is more clearly seen.

In the example depicted in FIG. 6, the closure member 44 has one or more openings 44*c* formed longitudinally through the closure member. The closure member 44 is also slidingly and sealingly received in a sleeve 68*a* extending downwardly (as viewed in FIG. 6) from the adapter 68.

One or more seals 74 are sealingly engaged between the sleeve 68*a* and an exterior surface of the closure member 44. Thus, with the closure member 44 in sealing engagement with the seat 46 (e.g., with the FIG. 3 sealing surfaces 44*a* or *b*, and 46*a* or *b*, sealingly engaged with each other), fluid flow through the flow restrictor 42 and passage 38 is prevented.

The openings 44*c* provide for fluid communication between the flow passage 38 downstream of the flow restrictor 42, and an annular chamber 76 formed radially between the stem 52 and the adapter sleeve 68*a*. The chamber 76 is also positioned longitudinally between the seal 64 and the seals 74.

However, the scope of this disclosure is not limited to use of the openings 44*c* in the closure member 44 for providing fluid communication between the passage 38 and the chamber 76. In other examples, fluid communication could be provided via one or more openings or other fluid flow paths in the stem 52, in a retainer 78 used to releasably secure the closure member 44 to the stem, or in another component of the flow choke 24.

Pressures in the annular chamber 76 and in the flow passage 38 are equalized in the open configuration depicted in FIG. 3 (and in intermediate positions of the closure member 44 between its open and closed positions). Thus, there is no net force exerted on the closure member 44 in the longitudinal direction (along the longitudinal axis 48) due to the pressure in the flow passage 38 and annular chamber 76. The closure member 44 is, therefore, pressure balanced in the longitudinal direction.

The actuator 50 (via the stem 52) can exert a longitudinal force on the closure member 44, for example, to maintain the closure member in its closed position or to displace the closure member to its open position or an intermediate position. Note that, in order to exert a net downward biasing force on the closure member 44, the actuator 50 will apply to the stem 52 a downward force only greater than an upward force due to the pressure in the flow passage 38 applied across a cross-sectional area of the stem (and not across a cross-sectional area of the closure member 44, since the closure member is pressure balanced). This reduces a need for the actuator 50 to apply such large longitudinal forces.

Figure 7:
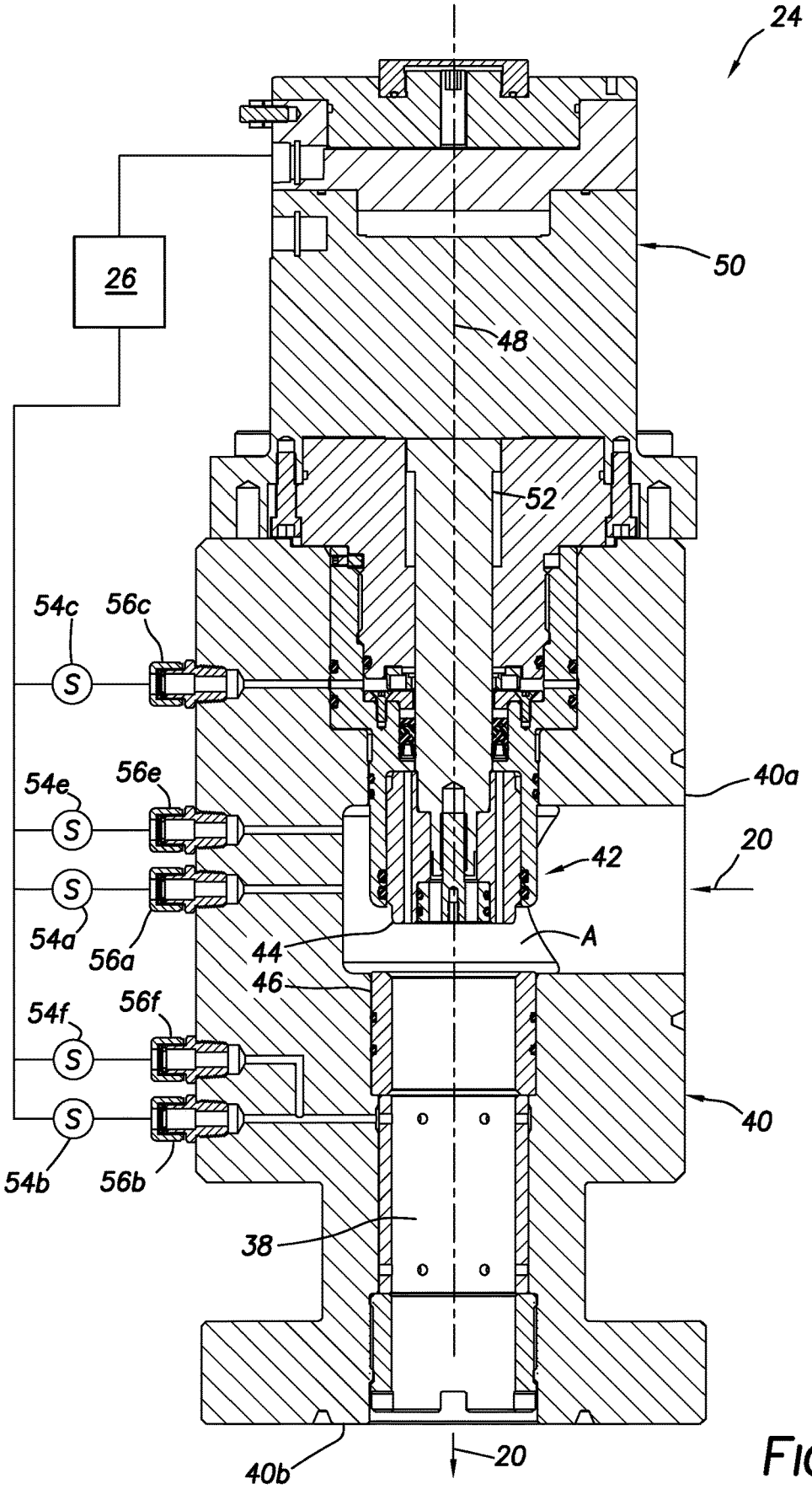
FIG. 7 is a representative cross-sectional view of another example of the flow choke.

Referring additionally now to FIG. 7, another example of the flow choke 24 is representatively illustrated. In this example, additional ports 56*e,f* and sensors 54*e,f* are provided. The sensor 54*e* is in fluid communication with the flow passage 38 upstream of the flow restrictor 42 via the port 56*e*, and the sensor 54*f* is in fluid communication with the flow passage 38 downstream of the flow restrictor 42 via the port 56*f*.

The sensors 54*e,f* measure a density of the fluid 20 flowing through the passage 38, respectively upstream and downstream of the flow restrictor 42. A suitable density sensor for use as the sensors 54*e,f* with the FIG. 7 flow choke 24 is marketed by Rheonics, Inc. of Sugar Land, Tex., USA. A "DV" family of sensors available from Rheonics can measure viscosity in addition to density. However, any suitable density sensor may be used for the sensors 54*e,f* in keeping with the principles of this disclosure.

A combination of flow rate, density, and temperature measurements (from the sensors 28, 54*a,b,e,f*) can provide much of the same capability as a typical Coriolis flow meter (e.g., measurement of mass flow rate), with the additional capability of the adjustable flow restrictor 42 downstream of the sensors 54*a,e* and upstream of the sensors 54*b,f*. For example, from the density measurements, the fluid 20 specific gravity SG can be more accurately determined to improve flow rate Q calculation (see equation 2 above) in real-time. In addition, measurement of density upstream and downstream of the flow restrictor 42 will provide more information, for example, to determine if there is a phase change to the fluid 20 as it flows through the flow choke 24.

Note that the sensors 54*e,f* and ports 56*e,f* are depicted in FIG. 7 as being positioned in a same lateral plane as the sensors 54*a,b* and ports 56*a,b*. However, in other examples, the sensors 54*e,f* or ports 56*e,f* may not be positioned in the same lateral plane as the sensors 54*a,b* and ports 56*a,b*.

Although separate sensors 54*a,e* and 54*b,f* are depicted in FIG. 7 respectively upstream and downstream of the flow restrictor 42, any or all of these sensors could be combined, or different combinations of sensors could be used. The sensors 54*a,e* are depicted in FIG. 7 as being in fluid communication with the flow passage 38 via separate flow paths or fluid lines formed in the body 40, but the flow paths could be combined or could intersect in the body (as depicted for the sensors 54*b,f*) in other examples. Thus, the scope of this disclosure is not limited to any particular combination, arrangement, configuration or number of the sensors 54*a,b,e,f* or ports 56*a,b,e,f*, or to any manner of placing the sensors in fluid communication with the flow passage 38.

It may now be fully appreciated that the above disclosure provides significant advancements to the art of constructing and utilizing flow chokes and associated well systems. In examples described above, the flow choke 24 is provided with the external ports 56*a,b,e,f* that can facilitate determining fluid flow rate through the flow choke, external ports 56*c,d* that can facilitate early detection of seal 64, 74 leakage, sealing of the actuator stem 52 against the fluid 20 and pressure in the flow passage 38, and pressure balancing of the closure member 44.

The above disclosure provides to the art a flow choke 24 for use with a subterranean well. In one example, the flow choke 24 can include a variable flow restrictor 42 configured to restrict flow through a flow passage 38 extending through the flow choke 24, a first external port 56*a* in communication with the flow passage 38 upstream of the flow restrictor 42, a second external port 56*b* in communication with the flow passage 38 downstream of the flow restrictor 42, and at least one sensor 54*a,b* in communication with the first and second external ports 56*a,b*.

The "at least one" sensor may comprise first and second pressure sensors 54*a,b*. The first pressure sensor 54*a* may be in communication with the first external port 56*a*, and the second pressure sensor 54*b* may be in communication with the second external port 56*b*.

The "at least one" sensor may comprise first and second density sensors 54*e,f*. The first density sensor 54*e* may be in communication with an external port 56*a* or *e*, and the second density sensor 54*f* in communication with the second external port 56*b* or *f*.

The flow choke 24 may include an actuator 50 including a displaceable stem 52. A restriction to the flow through the flow passage 38 may be varied in response to displacement of the stem 52.

A stem seal 64 may sealingly engage the stem 52 and isolate the actuator 50 from fluid pressure in the flow passage 38. The stem seal 64 may isolate the actuator 50 from the fluid pressure in the flow passage 38 downstream of the flow restrictor 42, in a closed configuration of the flow choke 24.

The flow choke 24 may include a third external port 56*c* in communication with a stem chamber 66 surrounding the stem 52. The third external port 56*c* may be isolated by the stem seal 64 from the fluid pressure in the flow passage 38.

The flow choke 24 may include a fourth external port 56*d* in communication with a sleeve chamber 70. The sleeve chamber 70 may be positioned external to a sleeve 68*a* in which a closure member 44 of the flow restrictor 42 is slidingly and sealingly received. The sleeve chamber 70 may be isolated from the flow passage 38 by a sleeve seal 72.

In open and intermediate configurations of the flow choke 24, a longitudinally displaceable closure member 44 of the flow restrictor 42 may be pressure balanced in a longitudinal direction.

A method of controlling flow of a well fluid 20 is also provided to the art by the above disclosure. In one example, the method can include the steps of: flowing the well fluid 20 through a flow passage 38 formed through a body 40 of a flow choke 24, the flow choke 24 including a flow restrictor 42, the flow restrictor 42 being operable to variably restrict flow through the flow passage 38; measuring a pressure differential ΔP between first and second external ports 56*a,b* of the flow choke 24, the first and second external ports 56*a,b* being in communication through the body 40 with respective upstream and downstream sides of the flow restrictor 42; and operating the flow restrictor 42, thereby varying a restriction to the flow through the flow passage 38, in response to the measured pressure differential ΔP.

The varying step can include varying the restriction to the flow through the flow passage 38 in response to a change in the measured pressure differential ΔP.

The method may include the step of determining a flow rate Q of the well fluid 20 through the flow passage 38, based on the measured pressure differential ΔP.

The method may include the steps of: connecting at least one pressure sensor 54*a,b* to the first and second external ports 56*a,b*; receiving an output of the at least one pressure sensor 54*a,b* by a control system 26; and the control system 26 operating an actuator 50 of the flow choke 24.

The "at least one pressure sensor" may comprise first and second pressure sensors 54*a,b*. The connecting step may include connecting the first and second pressure sensors 54*a,b* to the respective first and second external ports 56*a,b*. The output received by the control system 26 can comprise outputs of the first and second pressure sensors 54*a,b*.

The operating step may include longitudinally displacing a closure member 44 of the flow restrictor 42. The method may further include balancing pressure across the closure member 44 in a longitudinal direction when the closure member 44 is not engaged with a seat 46 of the flow restrictor 42.

The operating step may include displacing an actuator stem 52 of the flow choke 24. The method may further include sealing about the actuator stem 52, thereby isolating the actuator 50 from the flow passage 38.

The method may include measuring density of a fluid 20 in the flow passage 38. The density measuring step may include measuring the density upstream and downstream of the flow restrictor 42.

Also described above is a system 10 for use with a subterranean well. In one example, the well system 10 can include a pump 18 that pumps a well fluid 20, a flow choke 24 comprising a variable flow restrictor 42 that restricts flow of the well fluid 20 through a flow passage 38 extending through the flow choke 24, the variable flow restrictor 42 being operable by an actuator 50 that includes a displaceable stem 52, and the flow choke 24 further comprising a stem seal 64 that isolates the actuator 50 from the well fluid 20 in the flow choke 24, and a control system 26 that operates the actuator 50.

The stem seal 64 may isolate the actuator 50 from fluid pressure in the flow passage 38 upstream of the flow restrictor 42, in a closed configuration of the flow choke 24.

In open and intermediate configurations of the flow choke 24, a longitudinally displaceable closure member 44 of the flow restrictor 42 may be pressure balanced in a longitudinal direction.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A flow choke for use with a subterranean well, the flow choke comprising:

a variable flow restrictor configured to restrict flow through a flow passage extending through the flow choke, in which, in open and intermediate configurations of the flow choke, a longitudinally displaceable closure member of the flow restrictor is pressure balanced in a longitudinal direction due to well pressure acting on opposite ends of the flow restrictor;

a first external port in communication with the flow passage upstream of the flow restrictor;

a second external port in communication with the flow passage downstream of the flow restrictor; and at least one sensor in communication with the first and second external ports.

2. The flow choke of claim 1, in which the at least one sensor comprises first and second pressure sensors, the first pressure sensor being in communication with the first external port, and the second pressure sensor being in communication with the second external port.

3. The flow choke of claim 1, in which the at least one sensor comprises first and second density sensors, the first density sensor being in communication with the first external port, and the second density sensor being in communication with the second external port.

4. The flow choke of claim 1, further comprising:

an actuator including a displaceable stem, a restriction to the flow through the flow passage being varied in response to displacement of the stem; and a stem seal that sealingly engages the stem and isolates the actuator from fluid pressure in the flow passage.

5. The flow choke of claim 4, in which the stem seal isolates the actuator from the fluid pressure in the flow passage downstream of the flow restrictor, in a closed configuration of the flow choke.

6. The flow choke of claim 4, further comprising a third external port in communication with a stem chamber surrounding the stem, the third external port being isolated by the stem seal from the fluid pressure in the flow passage.

7. The flow choke of claim 6, further comprising a fourth external port in communication with a sleeve chamber, the sleeve chamber being positioned external to a sleeve in which a closure member of the flow restrictor is slidingly and sealingly received, and the sleeve chamber being isolated from the flow passage by a sleeve seal.

8. A method of controlling flow of a well fluid, the method comprising:

flowing the well fluid through a flow passage formed through a body of a flow choke, the flow choke including a flow restrictor, the flow restrictor being operable to variably restrict flow through the flow passage, and in open and intermediate configurations of the flow choke, a longitudinally displaceable closure member of the flow restrictor is pressure balanced in a longitudinal direction due to well pressure acting on opposite ends of the flow restrictor;

measuring a pressure differential between first and second external ports of the flow choke, the first and second external ports being in communication through the body with respective upstream and downstream sides of the flow restrictor; and operating the flow restrictor, thereby varying a restriction to the flow through the flow passage, in response to the measured pressure differential.

9. The method of claim 8, in which the varying further comprises varying the restriction to the flow through the flow passage in response to a change in the measured pressure differential.

10. The method of claim 8, further comprising determining a flow rate of the well fluid through the flow passage, based on the measured pressure differential.

11. The method of claim 8, further comprising:

connecting at least one pressure sensor to the first and second external ports;

receiving an output of the at least one pressure sensor by a control system; and the control system operating an actuator of the flow choke.

12. The method of claim 11, in which the at least one pressure sensor comprises first and second pressure sensors, the connecting comprises connecting the first and second pressure sensors to the respective first and second external ports, and the output comprises outputs of the first and second pressure sensors.

13. The method of claim 8, in which the operating comprises displacing an actuator stem of the flow choke, and further comprising sealing about the actuator stem, thereby isolating the actuator from the flow passage.

14. The method of claim 8, further comprising measuring density of a fluid in the flow passage.

15. The method of claim 14, in which the density measuring comprising measuring the density upstream and downstream of the flow restrictor.

16. A method of controlling flow of a well fluid, the method comprising:

flowing the well fluid through a flow passage formed through a body of a flow choke, the flow choke including a flow restrictor, the flow restrictor being operable to variably restrict flow through the flow passage;

measuring a pressure differential between first and second external ports of the flow choke, the first and second external ports being in communication through the body with respective upstream and downstream sides of the flow restrictor; and operating the flow restrictor, thereby varying a restriction to the flow through the flow passage, in response to the measured pressure differential, in which the operating comprises longitudinally displacing a closure member of the flow restrictor, and further comprising balancing pressure across the closure member in a longitudinal direction when the closure member is disengaged from a seat of the flow restrictor.

17. A well system, comprising:

a pump that pumps a well fluid;

a flow choke comprising a variable flow restrictor that restricts flow of the well fluid through a flow passage extending through the flow choke, the variable flow restrictor being operable by an actuator that includes a displaceable stem, and the flow choke further comprising a stem seal that isolates the actuator from the well fluid in the flow choke, in which the stem seal is exposed to fluid pressure in the flow passage downstream of the flow restrictor, in a closed configuration of the flow choke; and a control system that operates the actuator, in which the flow choke further comprises a first external port in communication with the flow passage upstream of the flow restrictor, a second external port in communication with the flow passage downstream of the flow restrictor, and at least one sensor in communication with the first and second external ports.

18. The well system of claim 17, further comprising a third external port in communication with a stem chamber surrounding the stem, the third external port being isolated by the stem seal from fluid pressure in the flow passage.

19. The well system of claim 18, further comprising a fourth external port in communication with a sleeve chamber, the sleeve chamber being positioned external to a sleeve in which a closure member of the flow restrictor is slidingly and sealingly received, and the sleeve chamber being isolated from the flow passage by a sleeve seal.

20. The well system of claim 17, in which the at least one sensor comprises first and second density sensors, the first density sensor being in communication with the first external port, and the second density sensor being in communication with the second external port.

21. A well system, comprising:

a pump that pumps a well fluid;

a flow choke comprising a variable flow restrictor that restricts flow of the well fluid through a flow passage extending through the flow choke, the variable flow restrictor being operable by an actuator that includes a displaceable stem, and the flow choke further comprising a stem seal that isolates the actuator from the well fluid in the flow choke, in which, in open and intermediate configurations of the flow choke, a longitudinally displaceable closure member of the flow restrictor is pressure balanced in a longitudinal direction, and in which the flow choke further comprises a first external port in communication with the flow passage upstream of the flow restrictor, a second external port in communication with the flow passage downstream of the flow restrictor, and at least one sensor in communication with the first and second external ports.

22. A flow choke for use with a subterranean well, the flow choke comprising:

a body;

a variable flow restrictor configured to restrict flow through a flow passage extending through the body;

an actuator configured to displace a closure member of the flow restrictor relative to the body;

an adapter that connects the actuator to the body; and a sensor in communication with a chamber formed between the adapter and the body, in which a seal isolates the chamber from the flow passage, in which the chamber is positioned external to a sleeve in which the closure member is slidingly and sealingly received, and in which the sleeve extends into the flow passage.

23. The flow choke of claim 22, in which the sleeve is a portion of the adapter.

24. The flow choke of claim 22, in which the sensor detects whether a fluid is present in the chamber.

25. The flow choke of claim 22, in which the sensor detects pressure in the chamber.

26. The flow choke of claim 22, in which the sensor detects fluid leakage past the seal from the flow passage to the chamber.

27. A flow choke for use with a subterranean well, the flow choke comprising:

a body;

a variable flow restrictor configured to restrict flow through a flow passage extending through the body;

an actuator configured to displace a closure member of the flow restrictor relative to the body;

an adapter that connects the actuator to the body; and a sensor in communication with a chamber formed between the adapter and the body, in which the sensor is in fluid communication with the chamber via a fluid line extending through the body.

* * * * *